US005740131A

United States Patent [19]

Bernasconi

[11] Patent Number: 5,740,131

[45] Date of Patent: Apr. 14, 1998

[54] STABILISING OF AN ELECTRONIC CIRCUIT FOR REGULATING A MECHANICAL MOVEMENT OF A TIMEPIECE

[75] Inventor: Ermanno Bernasconi, Neuchâtel, Switzerland

[73] Assignee: Asulab S.A., Bienne, Switzerland

[21] Appl. No.: 845,406

[22] Filed: Apr. 25, 1997

[30] Foreign Application Priority Data

May 7, 1996 [FR] France ..... 96 05720

[51] Int. Cl.[6] ..... G04B 25/02; G04B 1/00

[52] U.S. Cl. ..... 368/148; 368/204

[58] Field of Search ..... 368/140, 147–149, 368/151, 157, 160, 168, 203–204; 522/8, 29, 46

[56] References Cited

U.S. PATENT DOCUMENTS

| | | | |
|---|---|---|---|
| 3,937,001 | 2/1976 | Berney | 58/23 D |
| 4,008,866 | 2/1977 | McClintock | 368/64 |
| 4,037,400 | 7/1977 | Kitai et al. | 368/204 |
| 4,312,058 | 1/1982 | Shida et al. | 368/66 |
| 4,799,003 | 1/1989 | Tu et al. | 322/29 |
| 4,910,720 | 3/1990 | Ray et al. | 368/148 |
| 5,517,469 | 5/1996 | Wifet | 368/140 |

FOREIGN PATENT DOCUMENTS

| | | |
|---|---|---|
| 0 679 968 | 4/1994 | European Pat. Off. . |
| 3 903 706 | 8/1989 | Germany . |

*Primary Examiner*—Vit W. Miska

*Attorney, Agent, or Firm*—Griffin, Butler Whisenhunt & Kurtossy

[57] ABSTRACT

The timepiece comprises an electrical energy generator (3) comprising a rotor (3*a*) and means (3*b*) for supplying said electrical energy in response to rotation of said rotor (3*a*), a source of mechanical energy (2), measuring means (Trig) coupled to said generator (3) for producing measurement pulses of the angular frequency of an alternating voltage supplied by the generator (3), braking means (K) responsive to a braking command signal for applying a braking torque to said rotor (3*a*), an electronic circuit (1) comprising reference means (Osc) for producing a reference signal (FR), and slaving control means (Div, Cmp, Tmr) arranged to control said braking means (K) when said measurement pulses are ahead with respect to the reference signal.

6 Claims, 4 Drawing Sheets

STABILISING OF AN ELECTRONIC CIRCUIT FOR REGULATING A MECHANICAL MOVEMENT OF A TIMEPIECE

The present invention concerns a timepiece comprising an electrical energy generator comprising a rotor and means for supplying the electrical energy in response to rotation of the rotor, and being regulated by an electronic circuit comprising braking means of the rotor of the generator.

Generally, in such timepieces, an electrical energy source drives an electrical energy generator to power the electronic circuit. The rotor of the generator itself, may be braked by the electronic circuit so as to regulate the mechanical movement by slaving it to for example, the frequency of a quartz. The interest of such timepieces is to obtain a very precise movement, regulated by quartz or other, without requiring a battery or an accumulator having a limited lifetime.

Such a timepiece is described for example in the patent U.S. Pat. No. 3,937,001 in which the angular frequency of the alternating voltage of the generator is compared to the frequency of a quartz. In this device, when the angular frequency of the generator starts being ahead with respect to the pulses of the quartz, the rotor is braked by short-circuiting the generator via a resistor. But when the movement has a certain lead, the duration of braking of the rotor of the generator may become quite important, which has as a risk that the supply voltage coming from the generator may be insufficient for the electronic circuit.

The document EP-A-0 679 968 describes another timepiece which overcomes this inconvenience, by proposing to brake the rotor during a short and fixed time interval with respect to its rotation period. The document shows in particular that the braking must be effected at those instants at which the value of the alternating voltage coming from the generator is small. The braking pulses are thus applied at that instant at which the alternating voltage changes sign, which is detected by a comparator which has a threshold fixed to a reference voltage, the zero voltage.

It has, however, been noted that such timepieces need to be readjusted. Shaking of these timepieces or repetitive angular shocks thus provokes the watch being slow and this cannot be corrected by a slaving circuit.

FIGS. 1 to 4 illustrate the behaviours of the alternating voltage Ug and of the measuring pulses SM obtained with two threshold comparators of the state of the art. FIGS. 1 and 2 illustrate the results of measurements performed with zero-voltage threshold comparator. FIG. 1 represents the evolution of the voltage Ug as a function of time, the value zero of the voltage corresponding to a zero-threshold. FIG. 2 represents as a function of time the pulses SM at the output of the zero threshold comparator, the measurement signal SM varying from the state "0" to the state "1" according to the result of the comparison. More particularly, it can be seen that an electric parasite on the voltage Ug, at an instant t1 provokes the appearance of parasite pulses I1 on the measurement signal SM. This electric parasite may be simply a transfer of the ground noise.

Thus, the observed malfunctioning seems to be caused by a parasite pule I1 registered by the electronic circuit as being normal pulses I2 or I3 of the rotor.

A signal smoothing filter may be provided to suppress these parasite pulses. But this filtering delays the appearance of normal pulses. However, the braking pulses must be applied without any delay while the voltage Ug is low, as explained here above. This solution further requires large filter capacitors which goes against the desired miniaturisation and integration of the electronic circuit.

Another solution which may be considered consists in lifting the threshold of the comparator. However, the threshold of the comparator must fulfil two contradictory conditions. On the one hand, it must be sufficiently high to mask the parasite pulses. On the other hand, it must be sufficiently low so that the braking pulses appear when the voltage of the generator is low, as shown here above.

FIGS. 3 and 4 represent, in a similar manner as FIGS. 1 and 2, the measuring results obtained with a high threshold comparator. In an equivalent manner, the comparator could be a Schmidt-amplifier having two separated threshold values. The threshold Ut is represented as a dashed line in a time-diagram or chronogram of the voltage Ug of the generator, see FIG. 3. As shown, the generator voltage Ug thus drops during the braking at instant t4, and double pulses I4 and I5 appear (see FIG. 4), which goes against the desired result.

An object of the present invention is to stabilise the functioning of a timepiece with a mechanical movement regulated by an electronic circuit.

In particular, an object of the invention is to know the origin of such malfunctioning and to remedy this.

Another object is to obtain a miniature timepiece having an electronic circuit which is simple and reliable.

By trying to achieve these objects, the Applicant of the present invention identified a surprising phenomenon during elaborate and difficult experiments on such timepieces.

Indeed, it was observed by the Applicant that the threshold of the previously used detection circuits depends in fact on the value of the power supply voltage. In a surprising manner, during the braking of the rotor, the drop of the voltage of the generator suffices to deviate the threshold of the generator which thus generates a new pulse. Thus, for a usual comparator such as a Schmidt amplifier having a low positive threshold Uth and a low negative threshold Utb, the comparator provides double pulses instead of providing only one. Iindeed, the drop of the voltage Ug provided by the generator may reach a value which is greater than the positive threshold Uth of the comparator, thus provoking the appearance of a parasite pulse. This phenomenon only occurs during the braking command, thus just after the appearance of the first pulse.

It is the identification of this unappreciated problem which has allowed the Applicant to resolve it by a timepiece comprising:

- an electrical energy generator comprising a rotor and means for providing said electrical energy in response to a rotation of said rotor,
- a source of mechanical energy mechanically coupled to said rotor to cause said rotation of said rotor, measuring means coupled to said generator for producing measurement pulses of the angular frequency of an alternating voltage supplied by the generator which corresponds to the angular frequency of the rotor,
- braking means responsive to a braking command signal for applying a braking torque to said rotor, and
- an electronic circuit comprising reference means for producing a signal having a reference frequency, and slaving control means arranged to control said braking means when said measurement pulses are ahead with respect to the reference signal such that the reference frequency regulates the angular frequency of said rotor and of said mechanical source, said timepiece being characterised in that said electronic circuit further comprises inhibition means synchronous with said measurement pulses and arranged such as to avoid a splitting of said measurement pulses.

Thus, according to the invention, during the braking command, the detection of measurement pulses is inhibited so as to suppress such pulse splitting without substantially delaying the braking with respect to a sign change of the generator voltage.

Advantageously, the invention provides that the inhibition means are correlated to a braking command supplied by the slave control loop.

A preferred embodiment is characterised in that the inhibition means generate a braking command, the time delay of this command being controlled by the slave control loop.

Another embodiment provides for the inhibition means having a time base and being responsive to the appearance or the disappearance of a measurement pulse.

Other objects, features and advantages of the present invention will become apparent from the following description that will be made with reference to the accompanying drawings in which:

FIGS. 1 to 4, already mentioned, represent chronograms of the alternative tension and of the measurement pulses obtained by timepieces with mechanical movements regulated by an electronic circuit of the state of the art;

Figure 5:
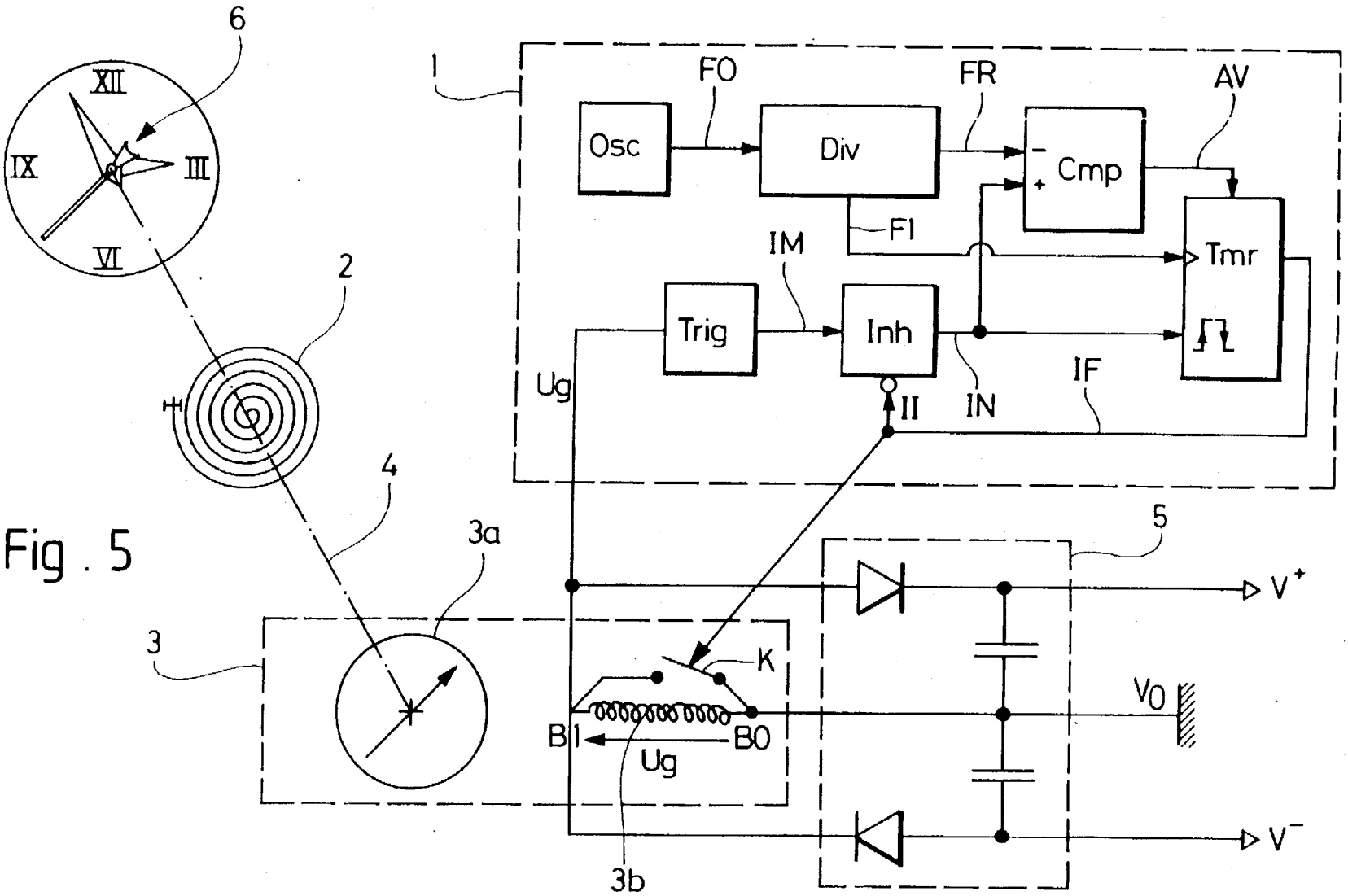
FIG. 5 represents a principal diagram of an electronic circuit for regulating a mechanical movement of a timepiece according to the invention.

The electromechanical part of the timepiece according to the invention is represented schematically in FIG. 5. It comprises a mechanical energy source 2 consisting of a barrel spring coupled via a gear train 4, symbolised by a chain-dotted line, to time display means 6, such as the hands of a watch face, the mechanical energy source 2 further being coupled to a rotor 3*a* of an electrical energy generator 3. Generator 3 further comprises an inductive coil 3*b*, rotor 3*a* comprising a bipolar magnet represented conventionally by an arrow. This part will not be described in detail here as it may be made in various ways well-known to specialists.

During functioning, mechanical energy source 2 rotationally drives rotor 3*a* and an alternating voltage Ug appears at the terminals B0, B1 of coil 3*b*. In the present case, terminal B0 is considered to be the reference terminal having a reference voltage V0. The voltage Ug of the generator will be measured at terminal B1, with respect to the reference voltage V0=0 Volts of terminal B0 (see FIG. 5).

This alternating voltage Ug is applied to a rectifier 5 for powering with a constant voltage an electronic regulating circuit 1 of the movement. An example of a preferred embodiment of a rectifier will be indicated further on.

As will be seen, electronic circuit 1 may regulate the mechanical movement of the timepiece by acting on braking means of rotor 3*a* of generator 3 which are provided to this effect.

The movement of the watch will indicate the actual time when the rotor rotates at a given speed, which will be called the normal speed.

The free speed of the rotor, i.e. without any braking, will be slightly faster than this normal speed. When the movement starts to run slow or to lag, the rotor will be allowed to turn at its free speed so as to make up for this lag. On the contrary, when the movement starts to run fast or to lead, a braking command provided by the electronic circuit 1 will limit the rotor speed to below the normal speed so that the movement will lose this lead. Other details concerning the choice of these speeds and the braking mode are given in document EP-A-0 679 968, mentioned here above, the contents of which is incorporated here above reference and to which reference will be made whenever necessary.

Thus, the timepiece further comprises measuring means for measuring the speed of the movement. They are constituted of, preferably, measuring means of the angular frequency of the rotor. The invention aims to obtain measurement pulses which correspond to each angular frequency of the rotor, for example, one pulse per revolution. These measurement pulses are in fact processed by the electronic circuit 1 so as to measure the deviation of the movement and to provide, if necessary, a braking command. These measuring means and the processing of the pulses will be described in more detail with the electronic circuit.

The braking is obtained by a short-circuiting of coil 3*b* of generator 3. The electric current which then flows through this deviation will thus provoke the appearance of a magnetic field which opposes itself to the cause of this current and to the movement of the rotor. It may be contemplated to redirect or deviate the current into a low value resistance. However, the preferred embodiment of the invention provides an electronic interrupter or switch K directly connected between the two terminals B0, B1 of coil 3*b* of the generator. A very powerful braking may thus be obtained.

Electronic switch K is advantageously constituted of a bipolar transistor or of a FET transistor as is explained in the above-mentioned document EP-A-0 679 968. Other equivalents are also well-known to specialists so that the functioning of this electronic switch K will not be described in detail here.

Naturally, such a short-circuit provokes a drop of the voltage Ug of the generator, the voltage becoming substantially zero during the braking command.

Figure 1:
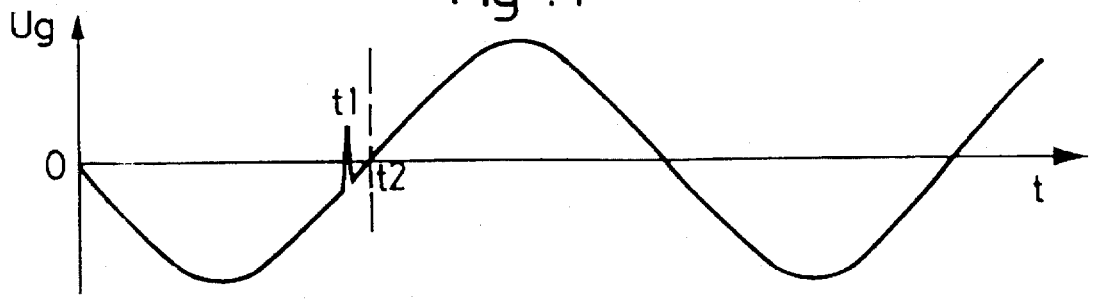
Figure 2:
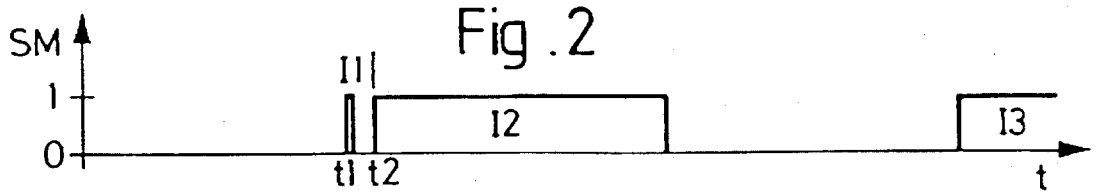
Figure 3:
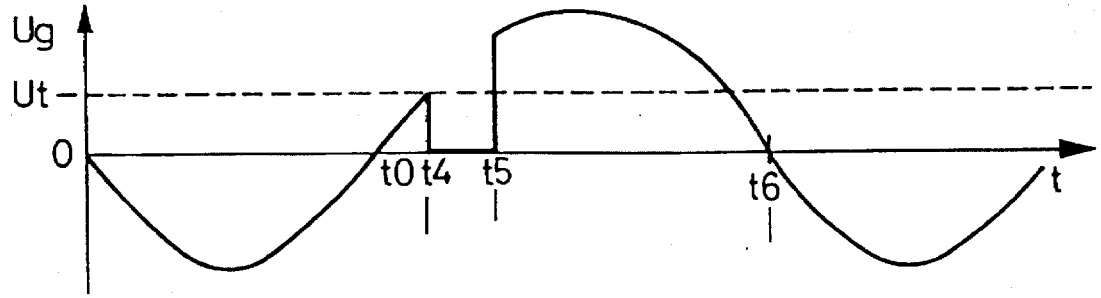
Figure 4:
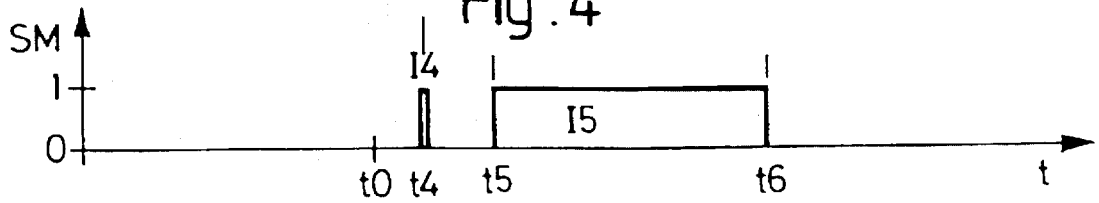

FIG. 3, already described here above, shows for example the pace of the alternating voltage Ug during a braking cycle, which may be compared to FIG. 1 representing the voltage Ug without any braking. It can be seen that during a half-period t0–t6, there is a time interval t4–t5, during which the braking is commanded, the short-circuited generator providing its entire energy to switch K.

The document EP-A-0 679 968 indicates that the braking command must be applied at that instance at which the voltage Ug is close to zero and during a small time interval, which is preferably inferior to ⅛ of the angular frequency of the alternating voltage Ug, to avoid a consecutive drop of the supply voltage V+, V− provided to the rectifier 5.

In an embodiment, rotor 3*a* thus has a normal speed of four revolutions per second and the duration of the braking pulses applied to switch K is limited to about 5 ms, i.e. 1/50 of the angular frequency of 250 ms of voltage Ug.

Electronic regulation circuit 1 of the movement of the timepiece such as illustrated in FIG. 5, is formed principally of an oscillator Osc providing a signal having a base frequency FO, of measuring means—referenced Trig and Inh—of the angular frequency of rotor 3*a*, and of a frequency slaving circuit controlling a braking command of the rotor.

The frequency slaving circuit commands the braking when the measurement pulses IN provided by the measuring means Trig, Inh, and which have a frequency corresponding to the angular frequency of the rotor, are leading with respect to pulses, referenced FR, which are provided by the oscillator Osc, and having a reference frequency taken from base frequency F0 of the oscillator Osc, for example by dividing the signal F0 so as to obtain a signal having the reference frequency.

To this effect, preferably, the slaving circuit comprises a frequency corrector Div which acts on the signal having a base frequency F0, and which provides pulses at a reference frequency FR. The corrector Div may simply be a frequency dividing circuit, well-known to specialists and will thus not be described in detail here.

It should however be mentioned that intermediate frequency pulses F1 may also be extracted from such circuits.

In the embodiment represented in FIG. 5, the oscillator Osc is a quartz having an own-frequency F0 of 32'768 Hz. The divider Div divides the signal having the frequency F0 so as to obtain a series of pulses FR having a reference frequency of 4 Hz corresponding to the normal angular frequency of the rotor. Finally, pulses F1 having an intermediate frequency of 4'096 Hz may also be extracted from the divider. As may be understood, these values are only given by way of example.

These pulses F1, which thus here have a period of 0.244 ms, are intended to serve as a time base or as a time delay control of the braking command mentioned here above and to serve as a clock synchronisation of the entire logic.

The slaving circuit further comprises a comparator, referenced Cmp, providing a signal AV which indicates the lead (or the lag) of the movement with respect to reference frequency FR. This comparator Cmp may be, for example, an up-down counter, or a reversible counter, which counts the difference of the number of measurement pulses IN, received at its input "+", and the number of reference pulses FR, received at its input "–", as described in the document mentioned here above EP-A-0 679 968. The state or the level of this signal AV which is available at the output of the comparator Cmp thus indicates if the angular frequency of the rotor is leading or not with respect to reference frequency FR.

The slaving circuit finally comprises a time-delay circuit, or register, and referenced Tmr, providing pulses of a determined duration. A first of two inputs of time-delay circuit Tmr is connected to the output of circuit Inh, and the other input receives from divider Div the pulses F1 used to determine the duration of its output pulses. The time-delay circuit further comprises a validation terminal receiving the signal AV of comparator Cmp. The time-delay circuit Tmr provides at its output braking pulses, referenced IF, with a fixed delay after the appearance of measurement IN, if however the signal AV indicates that the angular frequency of the rotor is leading with respect to reference frequency FR.

In this embodiment, the braking will have a duration which is shorter than 5 ms, by programming an internal counter of time-delay circuit Tmr which counts down 20 pulses F1 each having a period of 0.244 ms to generate a braking pulse IF thus having a duration of 4.88 ms.

Preferred embodiments of time-delay circuit Tmr will be described following the description of the measuring means of the angular frequency of the rotor.

Figure 6:
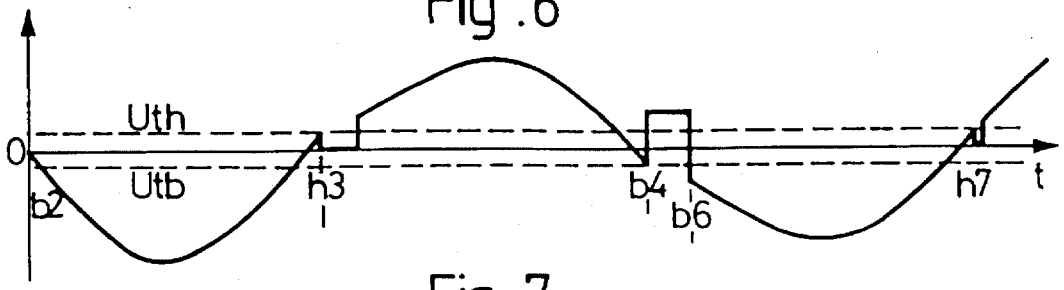
FIG. 6 represents a chronogram of the alternating voltage at the poles of a generator of a timepiece of FIG. 5.

FIG. 6 represents an example of a chronogram of the alternating voltage Ug provided by generator 3 when braking pulses are applied. In FIG. 6, there is indicated by a dotted line two levels of a threshold voltage Uth and Utb which have a small value with respect to the amplitude of the voltage Ug. The threshold Uth is positive and slightly larger than the reference value 0 Volts of the alternating voltage Ug. The threshold Utb is negative and, preferably, symmetrical to the threshold Uth with respect to this voltage of 0V.

Figure 7:
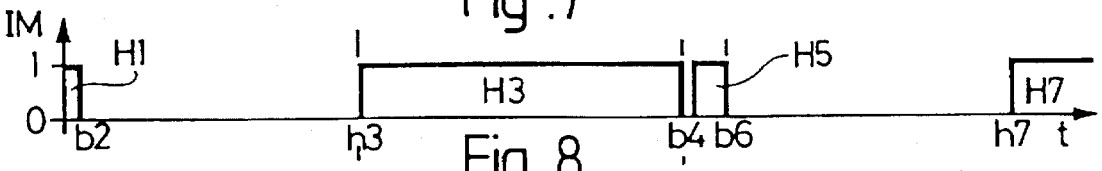
FIGS. 7 to 11 represent chronograms of pulses obtained at several points of the circuit of FIG. 5.
Figure 8:
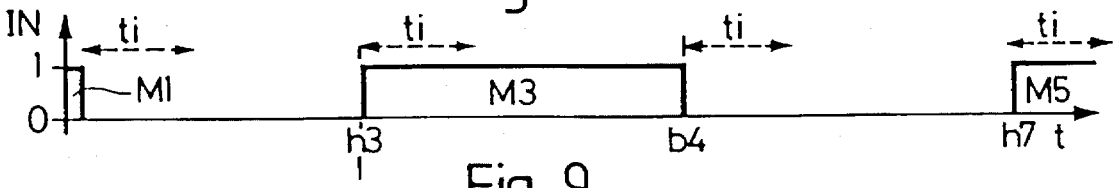
Figure 9:
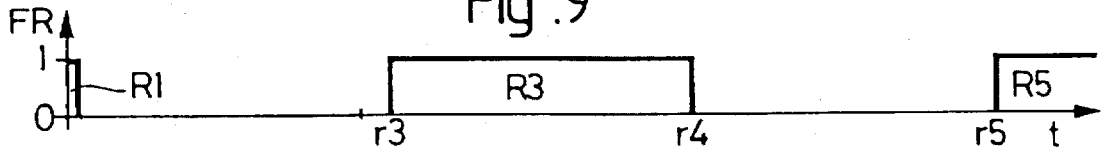
Figure 10:
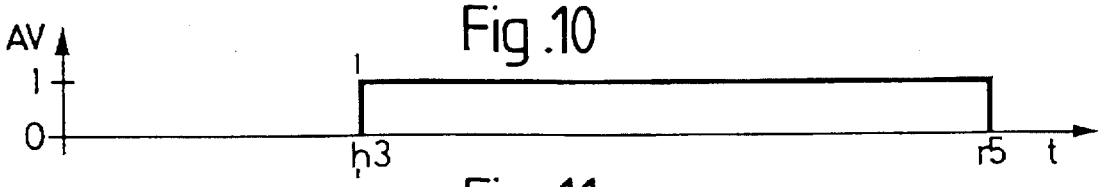

Preferably, the invention in fact allows for the measuring means of the angular frequency to comprise a hysteresis amplifier, or Schmidt-trigger, referenced Trig in FIG. 5. FIG. 7 shows a chronogram of pulses IM obtained at the output of the amplifier Trig. It may seen that the output IM of the amplifier changes to a first level (state "0") following the instant b2 at which the input voltage Ug becomes smaller than the low threshold Utb; the output IM rests at this first level as long as the voltage Ug does not become larger than the high threshold Uth. At the instant h3, the voltage Ug surpasses this threshold Uth, and the output IM changes to a second level (state "1"), thus generating a pulse H3 which lasts reciprocally until an instant b4 when the voltage Ug drops below the lower threshold Utb. The realisation of such an amplifier (also called Schmidt flip-flop or Schmidt-trigger) is well-known to specialists and will thus not be described in detail here.

An advantage of such a hysteresis amplifier is that it is hardly sensitive to electric noise, contrary to single threshold comparators of the state of the art (see FIG. 1). In particular, the trigger Trig which has a double threshold Uth, Utb does not register parasite voltages which are smaller than the difference between the thresholds Uth–Utb.

Furthermore, a Schmidt-trigger having a positive threshold Uth and a negative threshold Utb should not be sensitive to the returning of the voltage Ug to the zero value during the braking period.

However, in order to have two opposed threshold voltages Uth and Utb, electronic circuit 1 preferably has a continuous symmetric power supply V–, V0, V+. In a classical manner, a decent symmetric power supply has a generator in the middle and a simple rectifier together with a capacitor between each of two outputs V+ and V–, the reference output V0 being taken in the middle. An inconvenience of this solution is to diminish by half the amplitude of the measurable alternating voltage Ug, an amplitude which is already low at the terminals of a miniature coil 3*b*.

The preferred embodiment of the invention comprises a symmetric rectifier 5 as illustrated in FIG. 5. This rectifier comprises, in particular, a reference output V0 connected to the reference terminal B0 of generator 3, and two capacitors respectively arranged between a voltage output V+or V–, and the output V0. The functioning of rectifying circuit 5 intended to regulate a continuous power supply of electronic circuit 1 will not be described in detail here because it may be obtained in several manners well-known to specialists.

It should however be noted that each capacitor is recharged at each alternation substantially to a level corresponding to the maximum value of the alternating voltage Ug.

In FIG. 7, it can be seen that output signal IM of trigger Trig does not stay at the low level (state "0") when the voltage Ug is less than the low threshold Utb of trigger Trig, thus from instant b4 on, but that this signal IM presents a splitting of pulse H3 into pulses H3 and H5.

The Applicant of the present invention discovered during laborious experiments, that this surprising phenomenon occurs while braking during the negative half alternation as illustrated in FIGS. 6 to 11. A braking cycle is represented for example in FIG. 10 by the state "1" of signal AV. This phenomenon seems caused by the deviation of the thresholds Uth and Utb of the Schmidt-trigger Trig. Indeed, it should be noted that there are no split pulses at the beginning of the braking cycle. FIG. 7 shows, for example, the absence of splits at the beginning of pulse H3, at the instant of the first braking pulse F3 represented schematically in FIG. 11. The splitting of pulse H3–H5 appears only at the second braking pulse F4. In fact, the maximum value of the alternating voltage Ug is diminished after the first braking pulse F3. Also, the value of the rectifier voltage V+ becomes smaller. This deviation of the supply voltage seems to provoke a deviation of the thresholds Uth and Utb of trigger Trig. It was thus noticed that, at the following braking pulse F4, the drop of voltage Ug may obtain a value which is greater than the value of threshold Uth which thus causes the appearance of a parasite pulse H5 represented in FIG. 7. This phenomenon may also be provoked by the existence of a certain noise or trash voltage at the terminals of switch K (see FIG. 5). This trash voltage might prevent voltage Ug from returning to a totally zero value.

The present invention provides synchronous inhibition means of the measurement pulses to avoid this problem.

To this effect, electronic circuit 1 according to the invention further comprises a synchronous inhibition circuit Inh receiving the measurement pulses IM provided by the threshold comparator Trig, this set Inh, Trig thus constituting the measuring means of the angular frequency of rotor 3*a*.

The general expression of synchronous inhibition will be interpreted here as meaning an inhibition triggered by signals, preferably by pulses, which are internal to the system formed by a timepiece, its generator, the electronic circuit and its oscillator. In particular, the inhibition of measurement pulses could be synchronised with the pulses themselves, a first pulse starting the inhibition of the appearance of following pulses. As several equivalents are known to specialists, the present invention is considered to lend itself to all known synchronous inhibitions without specifying the synchronisation source.

According to a first embodiment, inhibition circuit Inh comprises a time base (internal or external) and, normally, transmits the measurement pulses IM coming from amplifier Trig directly to the time-delay circuit Tmr. However, when inhibition circuit Inh is activated, the circuit does not any more transmit the measurement pulses IM during an inhibition duration. The inhibition starts at the appearance and/or the disappearance of a pulse, i.e. the inhibition circuit reacts on the rising as well as the falling flank of pulses IM, and its activation duration $t_i$ is time delayed by its time base. For example, with reference to FIG. 6 and to FIGS. 7 and 8, which respectively represent the different pulses transmitted by amplifier Trig (FIG. 7) and by inhibition circuit Inh (FIG. 8), the inhibition circuit normally transmits measurement pulses H1, H3 and H7, by way of pulses M1, M3 and M5 respectively, because their transitions at instances b2, h3, b4, h7 are separated by time intervals which are longer than the inhibition time duration $t_i$, but this inhibition circuit does not transmit the parasite H5 which appears during the inhibition time $t_i$ starting at the falling front instant b4) of pulse H3, see FIG. 8.

According to a non-represented alternative of the first embodiment, the inhibition circuit generates a normal pulse IN of determined duration at each flank of measurement pulse IM unless this flank appears during a normal pulse IN. Such an inhibition circuit may be obtained in a manner analogue to time-delay circuit Tmr mentioned here above. Circuit inh comprises, for example, a monostable multivibrator which is sensitive to transitions of the measurement pulses IM applied to its input. At the rising flank of the pulse IM, the monostable thus provides at its output a normal pulse IN of determined duration. Also, at the falling flank of a pulse IM, the monostable provides another normal pulse IN of determined duration. It should be noted that such a monostable provides two normal pulses IN at each angular frequency of the rotor, so that the frequency of the normal pulses IN must be compared to a doubled reference frequency FR. It may be understood that other equivalent inhibition circuits well-known to the specialists may also be used.

Figure 11:
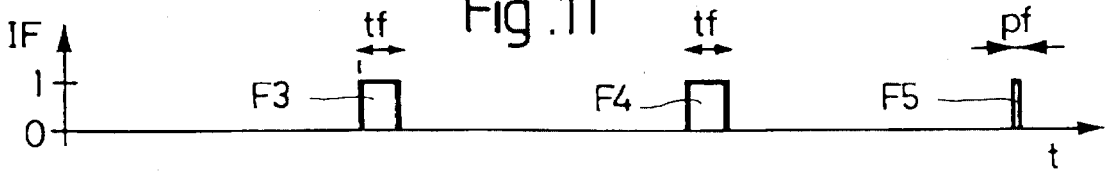

According to another embodiment, illustrated in FIG. 5, the inhibition circuit receives at an input pulses IF, represented in FIG. 11, each being a braking command for braking the rotor of the generator, issued by time-delay circuit Tmr and the inhibition corresponds to the braking duration tf, see FIG. 11. Indeed, as was observed, the parasite pulses due to the splitting only appear during the braking. A very simple synchronous inhibition is thus obtained.

The preferred embodiment of the invention comprises however an inhibition command II having a duration which is greater than the braking command IF, and which covers all the braking instants. Inhibition pulse II thus covers the instants following the end of braking pulse IF and the appearance of the pulse II may thus precede the appearance of this pulse IF. This "dissipation" ensures that delays of the propagation of the inhibition or the braking or of the voltage Ug do not trigger another parasite pulse. In the preferred embodiment of the invention, the time-delay circuit Tmr comprises two outputs which provide correlated inhibition pulses II and braking pulses IF.

The concept of "correlation" designates a simultaneous appearance, or an appearance with a substantially constant time delay, of two physical phenomena such as signals or pulses. It should however be noted that these two phenomena may have different durations. For example, the correlated time delayed pulses may have different widths, something which is well-known to the skilled person.

To illustrate the correlation of the pulses issued by time-delay circuit Tmr of the preferred embodiment, lets take the example in which the time-delay circuit Tmr receives the pulses F1 having a period 0.244 ms at a first input connected to the output of divider Div. When a normal pulse IN appears on the other input, which is connected to the output of the inhibition means, and if the state of the lead signal AV controls it by supplying a pulse to the validation input of the time-delay circuit (see FIG. 5), the time-delay circuit Tmr immediately provides an inhibition pulse II. A braking pulse IF also appears at the output of time-delay circuit Tmr delayed by a period F1 of 0.244 ms with respect to the start of inhibition pulse II, and an internal counter limits its duration to 21 pulses F1 which corresponds to 5.124 ms. Indeed, the internal counter must ensure that the braking duration is around 5 ms. Another internal counter limits the duration of pulse II to 25 pulses F1, which corresponds to 6.1 ms. Inhibition pulse II thus ends 0.723 ms after the end of braking pulse IF.

An embodiment of an electronic circuit of time-delay circuit Tmr providing such inhibition pulses II and braking pulses IF will now be described in detail with reference to FIG. 12. The circuit represented is a logic circuit receiving pulse signals having an intermediate frequency F1, the lead signal AV (or the lag signal) and the measurement pulses mentioned above, and which provides a braking pulses signal IF, an inhibition pulses signal II and a normal pulses signal IN as mentioned above.

Figure 12:
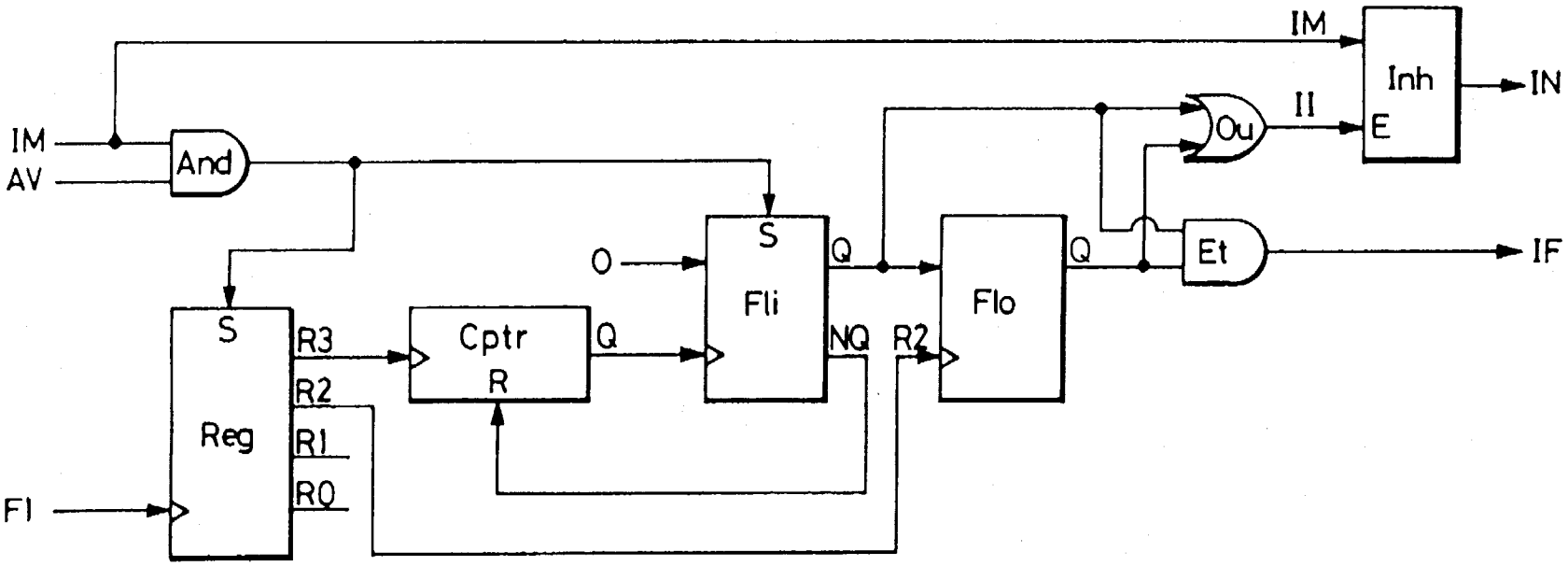
FIG. 12 represents schematically an embodiment of an electronic time-delay circuit Tmr of the electronic regulation circuit of FIG. 5.

The logic circuit of FIG. 12 comprises a shift register Reg receiving pulses F1 at its clock input, the register having four outputs R0, R1, R2 and R3, at which pulses appear successively.

According to the preceding example of an embodiment, the pulses F1 have a period of 0.244 ms. The output R3 thus generates pulses which have a period of 0.976 ms, similar to, but delayed by 0.244 ms with respect to the pulses at output R2. Furthermore, the register Reg comprises an activation terminal S which is connected to the output of an AND gate, referenced And, which performs the logic operation "and" between the lead signal AV and the measurement pulse signal IM. When the terminal S changes to the state "1", the register Reg is activated and output R1 changes to state "1". At the following pulse F1, the output R2 changes to the state "1", output R1 being reset to the state "0".

The output R3 is connected to a counter Cptr which will allow to limit the duration of the pulses IF, II and IN. The counter may, for example, count until the value five, a hold output Q changing to the state "1" after a countdown of five pulses R3. If the initialisation terminal R is at the state "1", the counting is initialised and output Q is reset to state "0". Output Q of counter Cptr is connected to the clock input of a D-type flip-flop Fli. This flip-flop further comprises a data input receiving the state "0". A terminal S for setting to "1" allows to force the state of output Q and NQ to the states "1" and "0" respectively. The terminal S for setting to "1" is also connected to the output of logic gate And.

It will now be considered that the angular frequency of the rotor is fast, i.e. is leading with respect to reference frequency FR. The lead signal AV is in the state "1". At the instant "h", when the voltage Ug surpasses, while rising, threshold Uth, a measurement pulse IM changes to state "1". The terminals S of register Reg and of flip-flop Fli are thus in the state "1". Flip-flop Fli is activated and its output Q changes to state "1". The output signal Q of flip-flop Fli is applied to an input of an OR gate, referenced Ou, whose output provides inhibition pulses II. From the instant "h" on, the inhibition pulses signal II thus changes to state "1". The OR gate performs in fact the logic operation "OR" between the output Q of flip-flop Fli and an output Q of another flip-flop Flo. This second flip-flop Flo, which is also a D-type flip-flop, receives at its data input the output signal Q of flip-flop Fli. However, the output signal R2 of the shift register Rag is applied to the clock input of flip-flop Flo. The transfer of the data Q to the output of the flip-flop Fli will thus be delayed until the following transition of signal R2. The two outputs Q of the flip-flops flops Fli and Flo are also applied to two inputs of an AND gate, referenced Et, performing the logical operation "AND". The output of the AND gate then provides the braking pulse signal IF.

By reconsidering the preceding example of an embodiment, the transition of signal R2 occurs 0.244 ms after instant "h". Thus the braking pulse IF appears 0.244 after the appearance of the inhibition pulse II.

Also, the output NQ of flip-flop Fli is connected to the initialisation terminal R of counter Cptr. At the instant "h", the output NQ changes to state "0", the counter is activated and starts counting the pulses F1 issued by register Reg. According to a counting example, after five periods of pulses R3, the output Q of counter Cptr changes to state "1". This transition on the clock input causes the flip-flop Fli to reproduce at its Q-output the state "1" of the data. The output NQ thus passes to state "1" by initialising the counter Cptr and its output Q. The outputs Q of counter Cptr and of flip-flop Fli thus stay in the state "1", this situation lasting as long as the transition of the state "0" to "1" does not appear on the setting terminal of flip-flop Fli.

In the preceding example of an embodiment, the counting of counter Cptr is synchronised with the signal R3 0.488 ms after the instant "h". The counting lasts 4.88 ms as indicated herebefore. Thus, 5.368 ms after instant "h", output Q of counter Cptr changes to state "1". Right after this, the outputs Q and NQ of flip-flop Fli return to state "0" and "1" respectively. The counting is reinitialised and stays this way until a next measurement pulse IM. The braking pulses signal IF thus returns to the state "0" at the instant "h"+5.368 ms.

However, the output Q of flip-flop Flo is still in state "1", until the next transition of output R2 of register Reg.

According to this embodiment, this transition occurs 0.732 ms after the re-initialisation of counter Cptr, i.e. at the instant "h"+6.1 ms. The inhibition pulse II thus disappears 0.732 ms after the disappearance of braking pulse IF.

The signals of time-delay circuit Tmr stay in this state as long as a new measurement pulse IM does not appear.

Finally, it can be seen that the time-delay circuit Tmr provides inhibition pulses II and braking pulses IF which are correlated, the duration of an inhibition pulse II being longer than and thus "dissipating" over the duration of the braking pulse IF to avoid any error during the switching.

The circuit of FIG. 12 also illustrates an embodiment of the inhibition circuit Inh. According to this example, the inhibition circuit Inh is a D-type flip-flop sensitive to the state of validation input E. The inhibition pulse signal II is applied to this input E, the data input receiving the measurement pulses IM and the data output providing the normal pulses IN.

During functioning, the output of normal pulses IN of such a circuit Inh duplicates the state of the measurement pulses signal IM only if the validation input E is in state "0". During the inhibition, i.e. when the inhibition signal II is in the state "1" (between the instant "h" and the instant "h"+6.1 ms, according to this embodiment), the state of the output remains unchanged independent of the transitions of the measurement pulses signal IM.

Finally, it may be seen that the inhibition means allow to eliminate the parasite pulses which cause a non-corrected lagging of the timepiece.

It may further be seen that the inhibition means combined with the measuring means comprising an hysteresis amplifier provide the timepiece with a good immunity against general electric parasites.

The capacitors of rectifier 5 may advantageously have relatively low capacities because it is not necessary here to provide extremely stable threshold voltages to the measuring means.

The skilled person will readily understand that several modifications may be applied to the timepiece described here above without departing from the scope of the present invention.

In particular, it should be mentioned that the duration of the braking pulses IF may be modulated according to the importance of the lead of the measurement pulses IM with respect to the reference pulses FR. This alternative is particularly suitable for a slaving circuit comprising a phase locked loop, the circuit thus providing a signal AV the level of which may vary proportionally to the phase-shift of the pulses IN with respect no the braking pulses IF, and the level of the signal AV thus modulating the duration of the braking pulses IF provided by time-delay circuit Tmr.

What I claim is:

1. A timepiece comprising:

an electrical energy generator comprising a rotor and means for supplying said electrical energy in response to rotation of said rotor, a source of mechanical energy mechanically coupled to said rotor to cause said rotation of said rotor, measuring means coupled to said generator for producing measurement pulses of the angular frequency of an alternating voltage supplied by the generator which corresponds to the angular frequency of the rotor, braking means responsive to a braking command signal for applying a braking torque to said rotor, and an electronic circuit comprising reference means for producing a signal having a reference frequency, and slaving control means arranged to control said braking means when said measurement pulses are ahead with respect to the reference signal such that the reference frequency regulates the angular frequency of said rotor and of said mechanical source, wherein said electronic circuit further comprises inhibition means synchronous with said measurement pulses and arranged such as to avoid a splitting of said measurement pulses.

2. A timepiece according to claim 1, wherein said inhibition means are correlated to said braking means.

3. A timepiece according to claim 1, wherein a braking command signal provided by a slave control loop is also used to control said inhibition means, the loop controlling a time delaying of said command.

4. A timepiece according to claim 1, wherein said inhibition means inhibit the transmission of measurement pulses during a time delay, the inhibition being triggered by the appearance or the disappearance of a measurement pulse.

5. A timepiece according to claim 1, wherein said measuring means (Trig) comprises a hysteresis filter such as a Schmidt-amplifier.

6. A timepiece according to claim 1, wherein the electrical generator is connected to a rectifier providing a symmetric power supply.

* * * * *